US007168454B2

(12) United States Patent
Vanderjeugt

(10) Patent No.: US 7,168,454 B2
(45) Date of Patent: Jan. 30, 2007

(54) HARNESS DEVICE FOR A WEAVING MACHINE

(75) Inventor: Bram Vanderjeugt, Ypres (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 342 days.

(21) Appl. No.: 10/758,245

(22) Filed: Jan. 16, 2004

(65) Prior Publication Data

US 2004/0159361 A1 Aug. 19, 2004

(30) Foreign Application Priority Data

Jan. 16, 2003 (BE) ..... 2003/0036

(51) Int. Cl.
*D03C 3/00* (2006.01)
*D03C 3/14* (2006.01)
*D03C 3/38* (2006.01)
*D03C 13/00* (2006.01)

(52) U.S. Cl. ..... 139/55; 139/55.1; 139/75; 139/82; 139/88; 139/87

(58) Field of Classification Search ..... 139/55.1, 139/59, 75, 82, 88, 87
See application file for complete search history.

(56) References Cited

U.S. PATENT DOCUMENTS 3,810,492 A * 5/1974 Lauritsen ..... 139/59
3,918,500 A * 11/1975 Katsumata ..... 139/59
4,125,135 A * 11/1978 Ebisch ..... 139/456
4,513,789 A * 4/1985 Bowen et al. ..... 139/85
4,777,986 A * 10/1988 Brochier ..... 139/86
4,936,352 A * 6/1990 Keim ..... 139/65
5,375,628 A * 12/1994 Hacker ..... 139/86
5,636,663 A * 6/1997 Lacroix ..... 139/86
6,494,237 B1 * 12/2002 Piegeler ..... 139/455
6,769,458 B2 * 8/2004 Froment ..... 139/59
7,007,721 B2 * 3/2006 Bassi et al. ..... 139/59
7,017,617 B2 * 3/2006 Bassi et al. ..... 139/59
7,025,094 B2 * 4/2006 Vanderjeugt et al. ..... 139/59

OTHER PUBLICATIONS

Field, et al., The appeal of plastics, Technology Review, p. 1.□□.*
British plastics federation, Injection Moulding, p. 1.*
American Plastics council, History of Plastic, entire document.*

* cited by examiner

*Primary Examiner*—Robert Muromoto
(74) *Attorney, Agent, or Firm*—James Creighton Wray

(57) ABSTRACT

A harness device for a weaving machine is made with partial apertured boards of synthetic material that can be manufactured by injection moulding. Each small partial apertured board has threading openings for pulling through harness cords, provisions to carry connecting elements and positioning means to position the connecting elements. Connecting elements connect one or several harness cords to one or several tackle cords or hooks. The threading openings or the connecting elements are provided with a spring-mounted retaining element and the connecting elements are provided with an opening through which one or several spindles may be passed.

14 Claims, 8 Drawing Sheets

HARNESS DEVICE FOR A WEAVING MACHINE

This application claims the benefit of Belgian Application No. 2003/0036 filed Jan. 16, 2003.

BACKGROUND OF THE INVENTION

On the one hand, this invention relates to a harness device for a weaving machine comprising an apertured board provided with threading openings for pulling through a series of harness cords and a method for building up such a harness device on the other hand.

In a Jacquard weaving machine, the harness is the connection between the warp yarns of the weaving machine and the hooks and/or the tackle system of the Jacquard machine driving the different positions of the warp yarns in the shed.

Building up the harness starts by fixing it to the bottom, after which a return spring is installed which is connected to a heddle, which, in turn, is connected to the harness cord. The harness cord moves through the cumber board towards the apertured board and also through the latter to be connected to the tackle cord transferring the motion of the hooks to the harness cord.

Several harness cords may be connected to the same tackle cord (so-called "repeats"), in order that the fabric may have a repeated pattern. These several harness cords being connected to one tackle cord may be realized above the apertured board (usually with weaving machines for flat fabrics), but may also be realized between the apertured board and the cumber board (usual with pile weaving machines).

Several methods are known to build up a harness: Now in the European patent no EP 472904 granted to Schroers, a description is given how the complete chain from the bottom-connection to the harness cord is completely prepared and pre-installed, to be subsequently inserted into the harness in order to carry out the levelling (=operation to bring all heddle eyes onto the same level) while the connection of one or several harness cords to form a connecting element is realized above the apertured board, which then is connected by means of the snap-hook connection.

A drawback of the method described in EP 472904 is that during installation each harness cord has to be pulled through from the bottom upwards through two boards (cumber board and apertured board).

If this is not done in the weaving machine but in a preparatory position, then the sizeable apertured board in its entirety has to be installed in the Jacquard weaving machine. In order to improve the implementation of this process, certain elements (connecting elements or thickenings) are applied which may be used as stops. The apertured board and the cumber board are made movable by means of a drive. Such a drive will make the Jacquard weaving machine more complicated and more expensive.

In a French patent FR 2 726 011 granted to Stäubli and the American patent U.S. 68 186 128 of DTF, building up of harnesses is described, enabling the harness cords to be engaged and disengaged from the tackle cords in groups or together, for all cords in one cycle of motion.

In both cases an additional guide board is needed in order to be able to present the connecting elements in an indexed manner. As a consequence the harness or tackle cord has also to be threaded through each of those boards (cumber board, apertured board and additional guide board). Here also, the sizeable apertured board has to be installed in its entirety on the weaving machine, when threading is carried out in a preparatory position. Here also, the bottom and/or cumber board are made movable which will render the Jacquard weaving machine more complicated and more expensive. In the French patent FR 2 726 011 connecting and disengaging occurs entirely in a vertical direction (this is also the direction in which the cords, connecting elements and return springs are operating, so that it is not unlikely for an element to be disengaged while it is still operating). In the American patent U.S. Pat. No. 68,186,128, engaging and disengaging occurs in a radial direction, which, because of the motions the engaging and disengaging devices has to perform, will render the device still more complicated and more expensive. Besides complexity and manufacturing price, it is also by no means certain that the result (connecting thousands of elements in one single operation) will be indeed obtained: inaccuracies and considerable forces required to connect the whole may result in a substantial number of elements being not, or not well, connected.

SUMMARY OF THE INVENTION

The purpose of the invention is to provide a method for building up a harness device, which, in a simple and cheaper manner will enable the harness to be prepared outside the weaving machine as much as possible and which will enable a quick, efficient and ergonomic installation in the weaving machine.

The purpose of this invention is attained by providing a harness device for a weaving machine comprising an apertured board provided with threading openings for threading a series of harness cords, this apertured board being composed of at least two separate detachable small partial apertured boards.

This has the advantage that the harness cords may be threaded through the small partial apertured boards during the preparatory installation and that the small partial apertured boards may be applied manually in a simple manner and without any expensive additional drives.

In a preferred embodiment of the invention the harness comprises a receiving grid for the said small partial apertured boards.

In a particular harness device, according to the invention the small partial apertured boards are made of synthetic material and preferably by means of an injection moulding process.

Manufacturing the small partial apertured boards by means of injection moulding has various advantages:

- More freedom of form, so that a better contact surface of the cords between boards and cords may be realized;
- The surface will be smoother and at the same times additives may be added having a friction reducing effect;
- There is no obligation for using standard thicknesses for the plate material, nor for a uniform thickness all over the entire surface;
- The actual cord passage can be made smaller, thus rendering the cord passage more accurate;
- The small partial apertured boards may be provided with fixing pins to be snap-fitted on a receiving grid;
- When certain passage openings should be worn out, there will be no need to replace the entire apertured board, but only parts of it may be replaced.

In a more particular embodiment of the harness device according to the invention, connecting elements are provided to connect one or several harness cords to one or several tackle cords or hooks and each small partial apertured board comprises threading openings and provisions to carry a number of connecting elements.

This has the advantage that when installing and dismantling the harness, the harness cords will be kept together and no further additional provisions to that effect will be required.

According to a particular embodiment of the invention, both threading openings and connecting elements may be provided with a spring-mounted retaining element.

In a more advantageous embodiment of the harness device according to the invention in each partial apertured board, recesses have been provided in addition to the threading openings in order to carry a number of connecting elements.

According to a particularly advantageous embodiment of the harness device according to the invention, a number of connecting elements have been provided with an opening, through which one or several spindles may be inserted, these spindles being able to rest on the small partial apertured boards in order to carry the connecting elements. Which means that the harness cords, when installed or removed, may be kept together in a more efficient manner.

In a most particular embodiment of the harness device according to the invention a number of connecting elements have been provided for connecting one or several harness cords to one or several tackle cords or hooks, and the partial apertured board comprises positioning means which have been provided to position a number of connecting elements in a connecting position desired.

In a preferred embodiment of the harness device according to the invention, the positioning means have been provided in the threading openings or in a recess provided next to the threading opening.

In a more preferred embodiment of the harness device according to the invention, the positioning means comprise one or several grooves and/or guide pins which are designed to co-operate with an edge of the connecting element in such a manner that the connecting element automatically takes up a connecting position when it is put into the threading opening or recess.

In a most preferred embodiment of the harness device according to the invention, the said positioning means comprise a spindle, which is guided through the openings of a series of connecting elements.

By making use of a spindle, an entire row of elements may be positioned (indexed). At the same time the spindle may serve as a carrier to keep the female elements above the apertured board.

In another preferred embodiment of the harness device according to the invention, these connecting elements in two pieces for connecting one or several harness cords to one or several tackle cords or hooks and the positioning means are designed to carry at least one part of a number of connecting elements.

Another purpose of this invention is a method for building up a harness device, which has been described according to this invention.

In a preferred method according to the invention, the harness cords are divided into different groups and are threaded in respective small partial apertured boards.

The advantage of this method is, that the harness cords may already be pulled through the respective small partial apertured boards during the preparatory installation.

In a particularly preferred method according to the invention, the harness device comprises connecting elements for connecting one or several harness cords to one or several tackle cords or hooks and these connecting elements comprise first and second parts to be connected, and the first parts carried by a partial apertured board are connected to the corresponding second parts by the same motion.

In a particularly advantageous method for building up a harness device according to the invention, a number of second parts of the connecting elements to be connected are kept in a connecting position by means of a comb. In case a number of connecting elements of both parts to be connected have been brought into a connecting position, they may be connected as a group.

In a more particularly preferred method according to the invention, one or several harness cords are connected to one or several tackle cords or hooks by means of connecting elements, and subsequently the small apertured boards are moved upwards while the connecting elements are pulled through respective threading openings and subsequently the small partial apertured boards are placed into a receiving grid, so that the complete apertured board is constituted.

In a most particularly preferred method according to the invention, one or several harness cords are connected to one or several tackle cords or hooks by means of connecting elements, and subsequently the small apertured boards are lowered. Subsequently the small partial apertured boards are placed into a receiving grid, so that the complete apertured board is constituted.

In this embodiment, the connecting elements do not have to be pulled through the respective threading openings, because in this embodiment the connecting elements, resting on the apertured board, will remain above the apertured board when the apertured board is lowered and will not be pulled through the threading openings.

Within the scope of this invention, various embodiments of the partial apertured boards are possible. The partial apertured boards with a maximum number of threading openings for the harness cords and/or tackle cords of 500 being preferred.

According to a particular embodiment, partial apertured boards are provided having less than 200 threading openings.

In another embodiment, this number may be situated between 12 and 100. In a most preferred embodiment 24 threading openings are provided. After having joined together the detachable partial apertured boards the apertured board thus composed comprises at least 1000 threading openings for the harness cords and/or tackle cords.

In order to further explain the qualities of this invention and to indicate its additional advantages and particulars a more detailed description of the harness device and the method for building up a harness device will now follow. It may be obvious that nothing in the following description may be interpreted as being a restriction of the protection of this invention demanded for in the attached claims.

In this description, by means of reference numbers, reference is made to the attached drawings, in which:

DETAILED DESCRIPTION OF THE PREFERRED EMBODIMENTS

Figure 1:
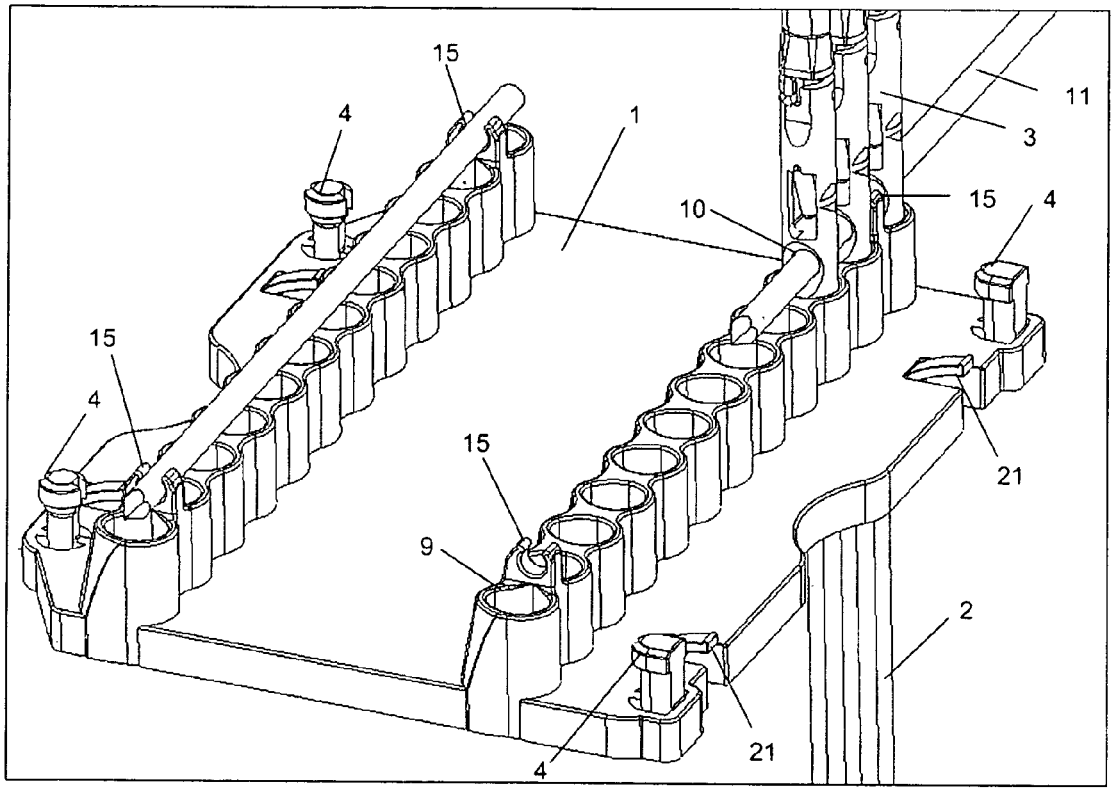
FIG. 1 is a perspective representation of the small partial apertured board.

The apertured board, which is a part of the harness device, according to the invention, is composed of at least two detachable small partial apertured boards (1). Possible embodiments of the small partial apertured boards are represented in the FIGS. 1, 7 and 9.

The partial apertured board (1), as represented in the figures, is provided with 24 threading openings (9) through which the harness cords (2) may be pulled already during the preparatory installation. The connecting element (3) intended to be connected to the tackle cord or hooks at the extremity of the harness cord (2) is carried out in such a manner that it may rest on this partial apertured board.

Preferably, the partial apertured board (1) is realized as an injection moulded part having the following advantages:

- More liberty of form, so that a better contact surface between the board and the cord will be realized, this is very important at the lower side of the apertured board;
- The surface will be smoother and at the same times additives may be added having a friction reducing effect;
- There is no obligation for using standard thicknesses for the plate material, nor for a uniform thickness all over the entire surface (this is advantageous for low weight and low manufacturing price);
- The actual cord passage can be made smaller, thus rendering the cord passage more accurate;
- The small partial apertured boards (1) may be provided with fixing pins (4) to be snap-fitted on a receiving grid (5), providing a simpler alignment of the machine;
- When certain threading openings should be worn out, there will be no need to replace the entire apertured board, but only parts of it may be replaced.

After the harness cords (2) have been pulled through the threading openings (9) in a preparatory installation, the small partial apertured boards (1) are brought into a preparatory position. In the preparatory position the small partial apertured boards (1) are placed into a receiving grid (5) and the first part (3) of the connecting element (3) is connected to the second part (7). Subsequently, the first parts are referred to as female connecting elements and the second parts as male counterelements.

After this connection has been effected a levelling operation takes place in which all heddle eyes are brought on the same level.

Once this levelling operation is finished the connections (3,7) may be released, the female parts (3) falling back onto the small partial apertured boards (1) and the small partial apertured boards being detached from the receiving grid (5).

In the method according to the state of the art, the harness cords have to be crossed to that effect, which means that the harness cords are interconnected in groups, for instance, by means of threads in order to avoid that the cords become entangled like "spaghetti" which may cause a great loss of time when installing the device in the Jacquard weaving machine.

In the method according to the invention this operation is no longer required as the cords (2) are already grouped per partial apertured board (1).

Figure 2A:
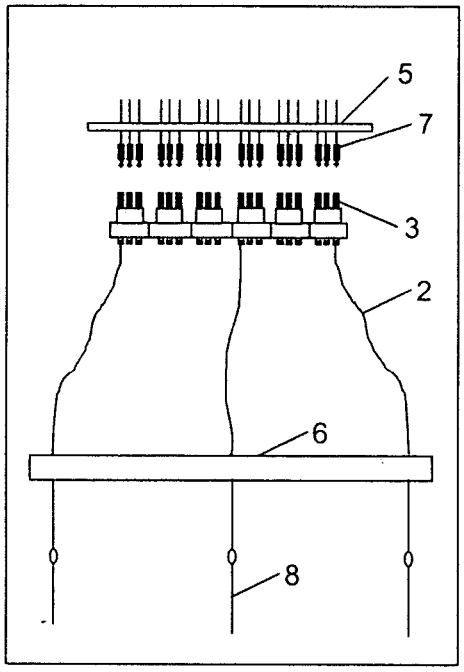
FIG. 2 is a representation of the small partial apertured board being raised in a weaving machine where the repeat connection occurs under the apertured board.
Figure 2B:
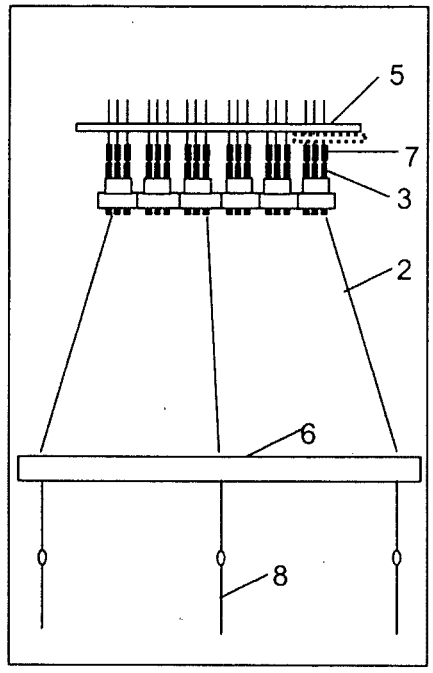
Figure 2C:
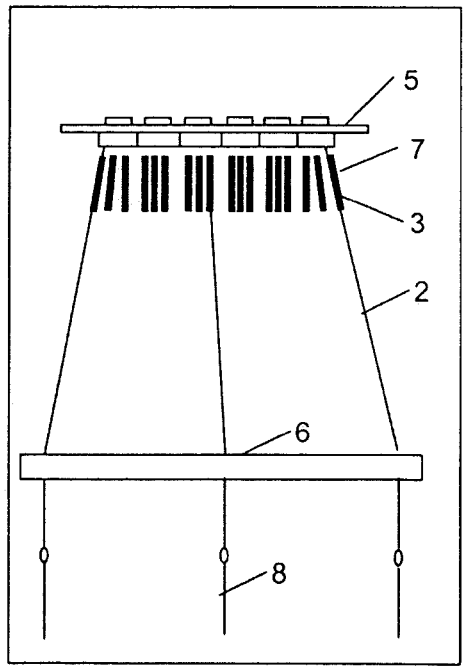

On installation in the weaving machine, partial apertured board (1) after partial apertured board (1) is taken and per partial apertured board (1) the female connecting elements (3) are connected to the male counterelements (7) (see FIG. 2).

In this connection the female (3) and the male (7) elements have to be indexed.

For the female elements (3), this may be done, for instance, by carrying out the openings (9) or the recesses (13) in the small partial apertured boards (1) such that during the "fall" of the connection into the apertured board (1) an indexed position is attained.

Figure 5:
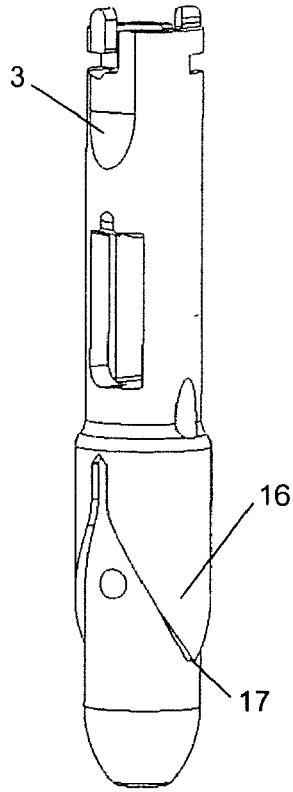
FIG. 5 is a representation of a female connecting element.
Figure 6A:
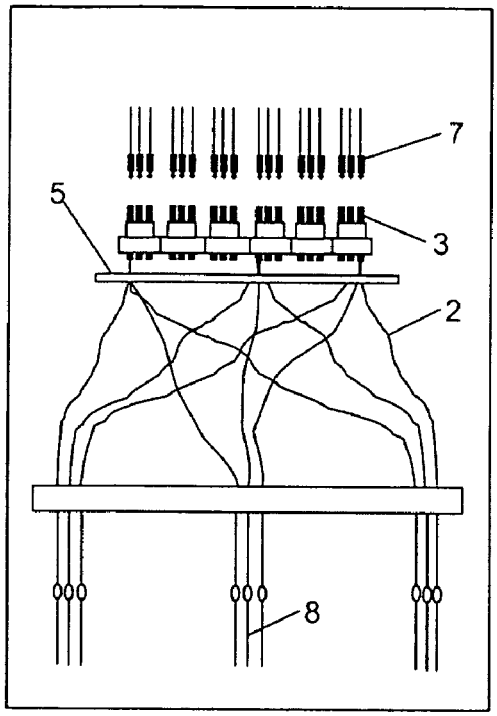
FIG. 6 is a representation of the small partial apertured board being lowered in a weaving machine where the repeat connection occurs above the apertured board.
Figure 6B:
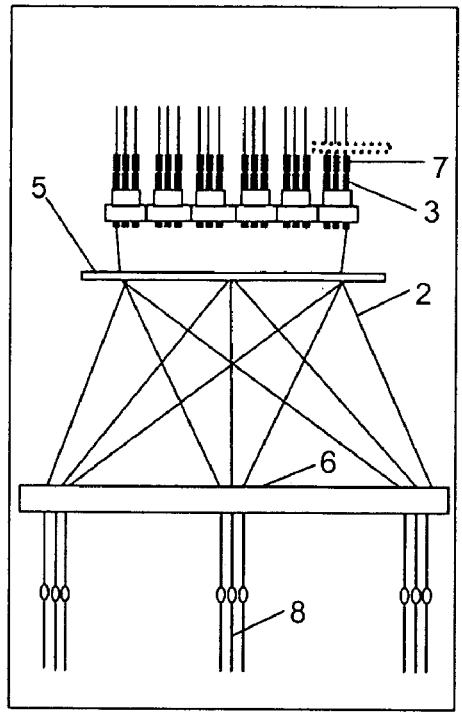
Figure 6C:
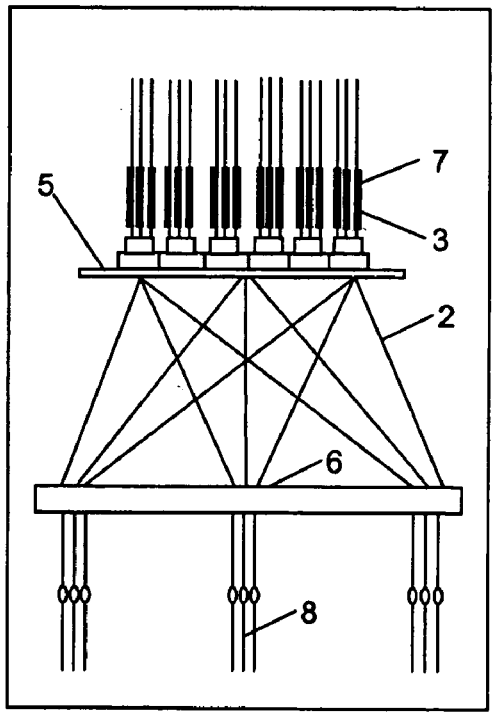

Hence, the female element (3) represented in FIG. 5, together with the threading opening (9) and/or the recess (13) is designed such that the element (3) will automatically index itself when resting in the partial apertured board (1). The female element (3), for instance, has a collar (16) with a cutout following a flowing line between two planes rotated through 90° with respect to one another. The cutout ends at the bottom, in a point (17). The counterpart in the threading opening (9) and/or the recess (13) of the partial apertured board (1) is a round hole in which, for instance, two guide pins (14) (see FIG. 6) have been installed, ending at the top in a point. When both connecting elements are axially moved towards one another, the point of the guide pin (14) will come in touch with the rotated collar (16) and will follow this shape till the guide pin (14) ends up in a straight groove. At this moment, the female element (3) of the quick-acting connecting device (3) will be orientated.

However, indexing the female elements (3) may occur during the preparatory installation, the female elements each having an opening (10), as in FIG. 1 for instance, through which a spindle (11) is slipped. This spindle (11) then performs both an indexing function of the row of elements and a carrier function in order to keep the female elements (3) above the partial apertured board (1).

Figure 3:
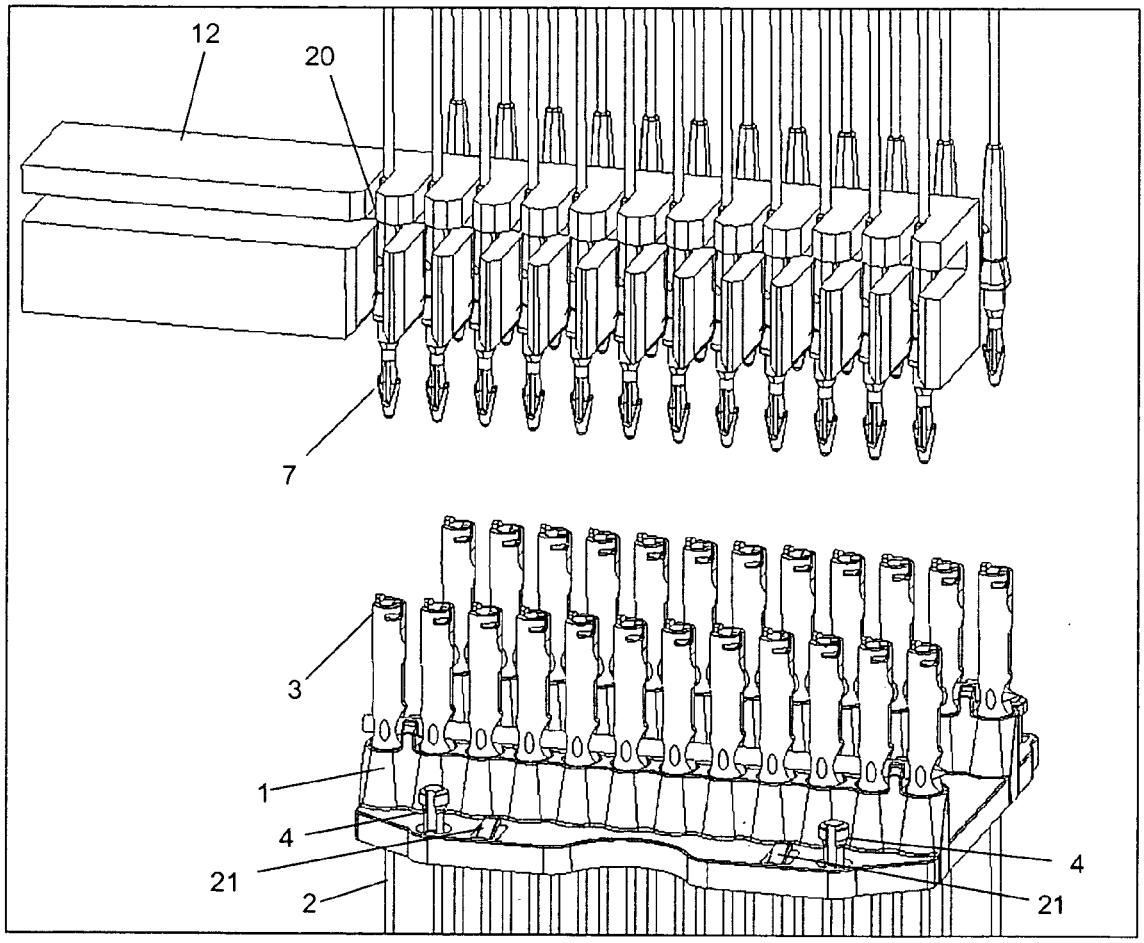
FIG. 3 is a representation of the indexing of the male connection elements.
Figure 4:
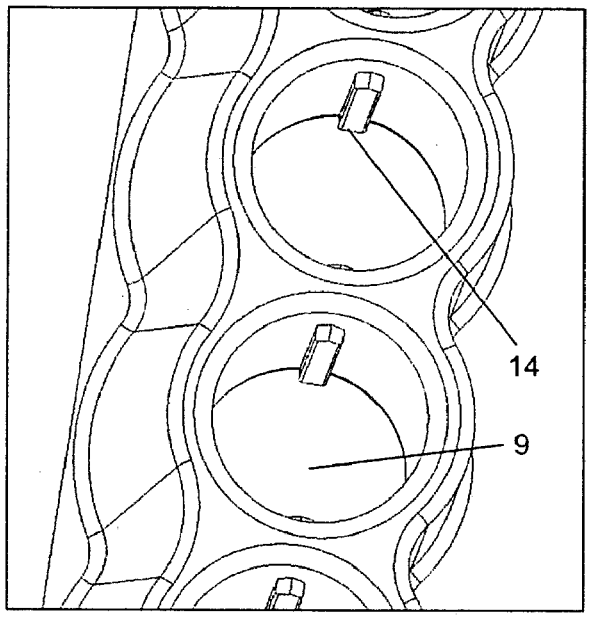
FIG. 4 is a representation of an opening provided with guide pins.

The male elements (7) may be indexed, for instance, by using a comb (12) enabling all, or part of the connections going together with a partial apertured board (1), to be orientated and engaged. In this manner, the male elements (7) in FIG. 3 are orientated by means of a forming comb (12). To that effect, the sides of the male elements (7) have been flattened (18), so that a curved rib (19) is formed. In the direction of the snap-on system, the rib changes into the original shape of the part, because a stop surface for the little spring is needed. The comb (12) is a bar, which has been provided with grooves (20), so that the cords may be slip in sideways, when the comb is pulled down. The curved rib (19) of the element (7) not yet orientated, will touch the wall of the grooves (20), as the width of the groove is smaller than the width of the part (measured between the two curved ribs). The downward force of the comb (12) is transferred into a rotating motion of the ribs, which will react against the wall of the groove. When the connecting element arrives opposite the little hole, the widening of the male element will enter the groove and the connecting element will be orientated as required. The connecting element will get stuck in the smaller hole at the top, which approaches the shape of the section of the connection because of the groove-shaped back room. Now the connection is well positioned to be connected to the female counterpart (3).

With an adapted comb (12), the male element may be rotated through 90° in order to allow the disengagement in a group.

Once the connecting is finished, the small partial apertured board (1), as represented in FIG. 2 is raised. This may be realized, for instance, by providing lips on the outside of the female connecting element (3) which are spring-mounted, so that from a certain force on, the small apertured boards (1) may be taken over the connection (3,7).

Figure 7:
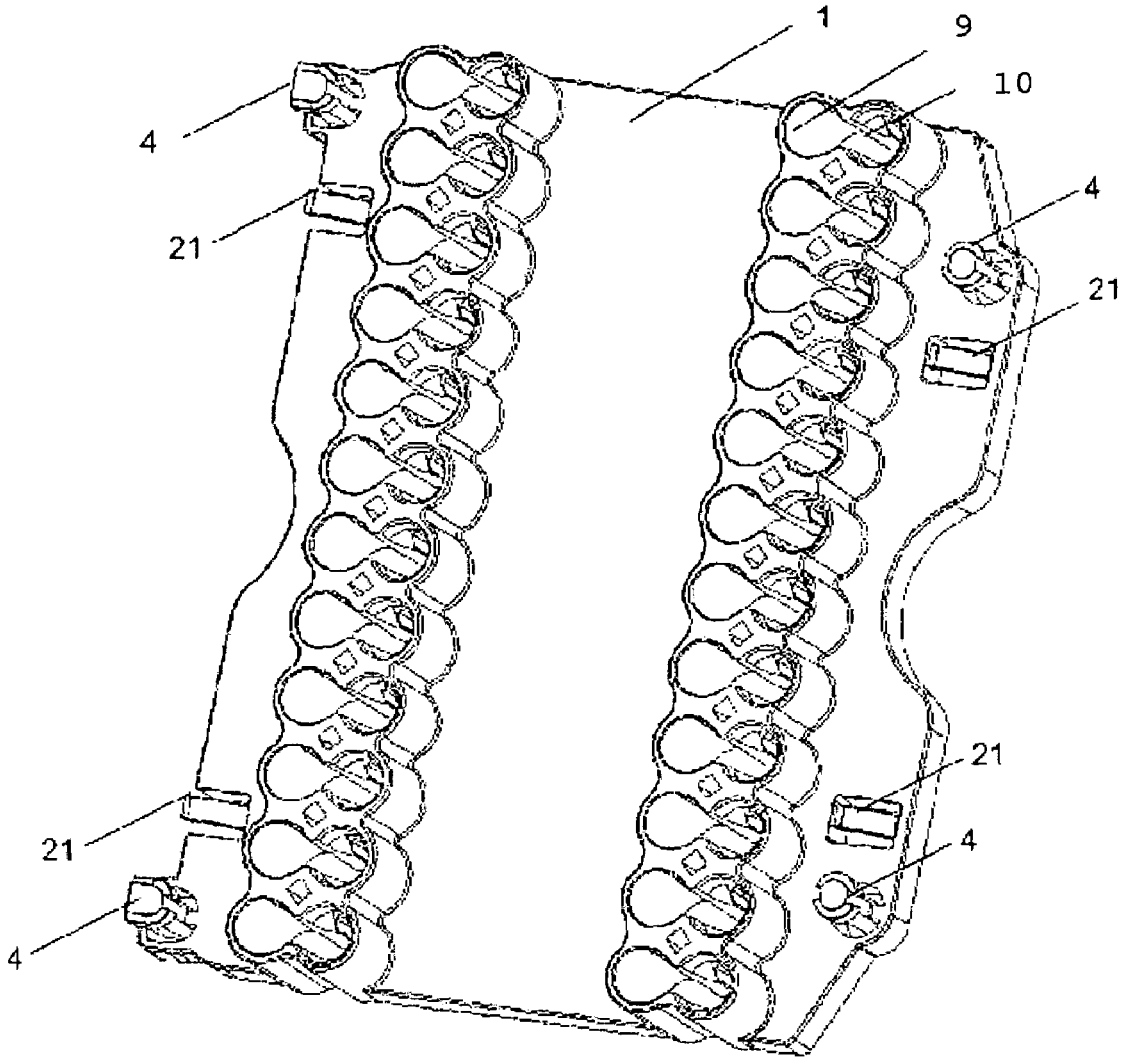
FIG. 7 is a perspective representation of the small partial apertured board.
Figure 8:
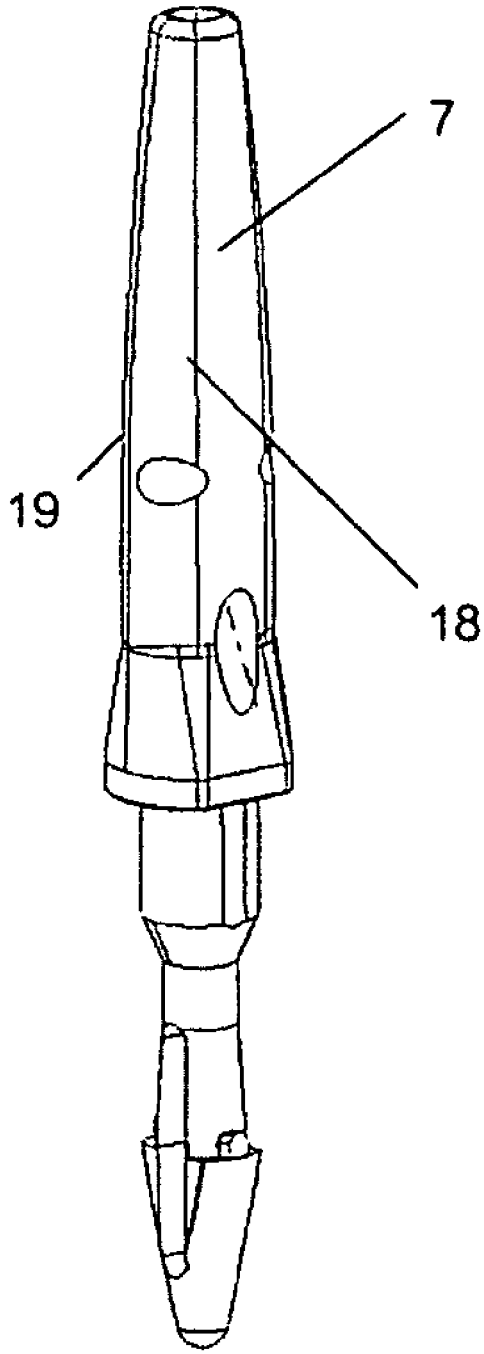
FIG. 8 is a representation of a male connecting element.

Another solution consists in doubling the threading openings 9 for the harness cords (2) as represented in FIG. 7, one opening (13) ensuring the positioning (indexing) of the female connecting elements (3) and another opening being the threading opening (9) for the quick-acting connection (3,7). After having been connected the connections have to be shifted from the positioning opening to the threading opening.

Figure 9:
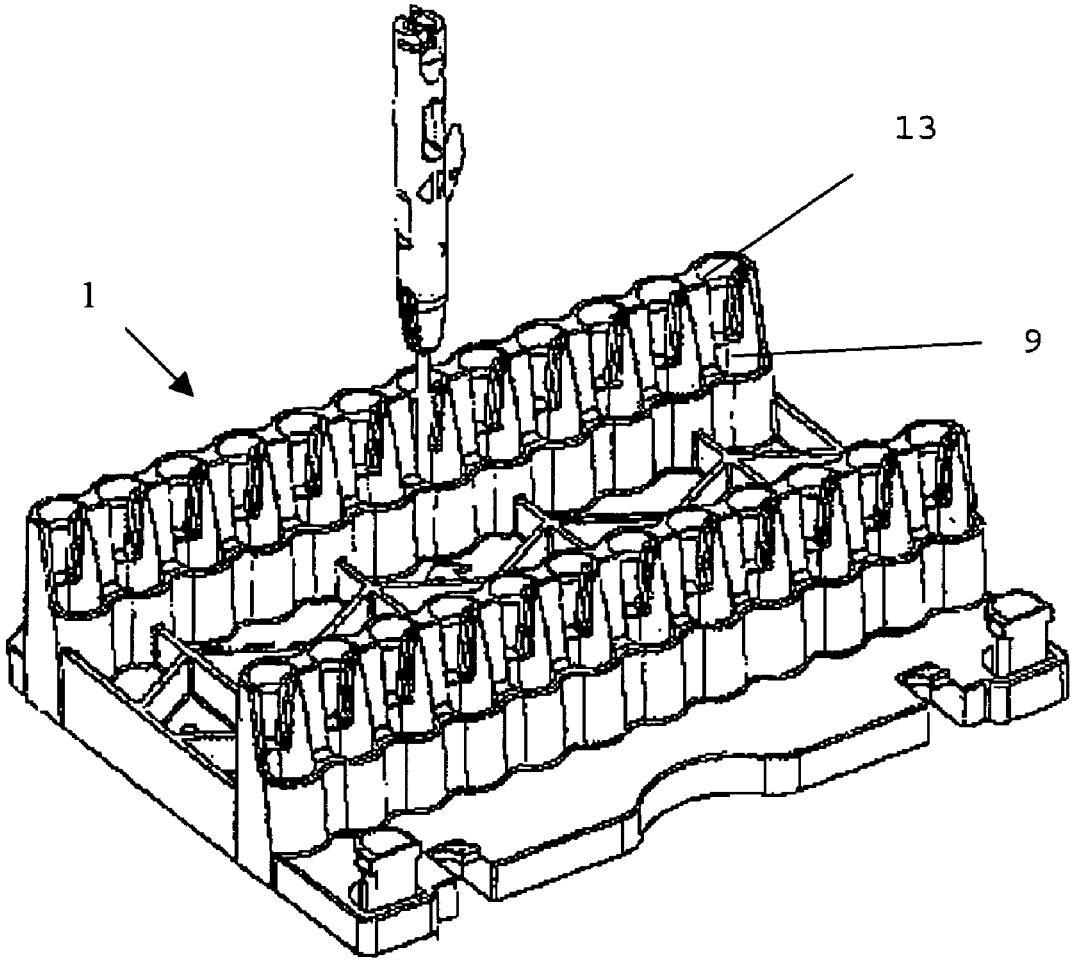
FIG. 9 is a perspective representation of the small partial apertured board provided with a conical cavity.

In FIG. 9, yet another variant is represented in order to make the connecting element between harness cord (2) and tackle cord rest on the partial apertured board (1) and have it both indexed (positioned) and pulled through the threading opening. In said figure the tops of the threading openings (9) have been provided with a conical recess (13) having one or several grooves into which the connecting element (3) fits and, in this manner, may be placed fixedly above the small partial apertured board (1) and may be indexed. Hereby the connection (3,7) has to be pulled through the partial apertured board (1) once, to be shifted sideways to fit into the conical cavity (13) and into the grooves. In order to release the connection (3,7) again it has to be lifted from the conical recess (13) and be conducted to the centre line of the threading opening (9).

There is yet another possibility consisting in providing the threading opening (9) with a spring which may be overcome in order to pull through the connection (3,7).

In the design where use is made of the spindle (11), this spindle (11) has to be removed before the partial apertured board (1) is raised. The apertured board (1), as an injection moulded part, may be provided with guidings (15) in order to apply or retain this indexing spindle (11).

After having raised the small partial apertured board (1), the small partial apertured board (1), together with its fixing pins (4), is snapped onto the receiving structure (5) provided to that effect to finally constitute a complete apertured board together with the other small partial apertured boards (1). The injection moulded part may be provided with spring-mounted lips (21) to secure the connection. This snapping on may occur from the lower side of the grid (5) or from the top of the grid (5). When connected to the lower side has the advantage of a simpler manipulation, but the weight and the forces being exerted on the small partial apertured board (1) are entirely absorbed by the fixing pins (of injected synthetic material) of the small apertured board (1). When connected to the top of the grid, the fixing pins (4) are no longer subjected to these loads, but the small apertured board (1) has to be pulled through the grid (5). Both top and bottom of the small apertured boards (1) may be provided with fixing pins in order to be suspended in a different manner in the preparatory position and in the Jacquard machine in view of the different action of the forces.

Inserting the small apertured boards (1) has the advantage that the harness cords (22) may be pulled through the apertured boards (1) during the preparatory installation at strongly reduced costs and with better ergonomics. The partial apertured board (1) is easily and flexibly to manipulate and there is no need for an expensive and complicated device for moving up and down the bottom and/or cumber board (6). Because of this, the height required for installation in the Jacquard weaving machine may be likewise reduced. Where in the past a sufficiently great free space was required above the apertured board to carry out manipulations at the level of the connection between the harness cords (2) and the tackle cords or hooks, this space is no longer required, because the corresponding partial apertured board (1) may be detached from the grid (5) during the manipulations and may be lowered and space needed above the small partial apertured board (1) may be generated.

It is obvious that also many advantages will be maintained with the method described, if no pre-levelling takes place and installation is carried out directly in the Jacquard weaving machine.

For weaving machines in which the repeat connections are carried out above the apertured board, the same method may be applied, under the understanding that this becomes essentially useful when the harness cords which are connected to the same tackle cord or heddle are pre-assembled and where in the method applied the small partial apertured boards (1) are lowered after having been connected and are attached to the receiving grid (5).

In this application it is no longer required that the female connecting elements (3) should have the possibility to be pulled through the partial apertured board (1). Preferably, in this application, the small partial apertured board (1) is attached to the top of the receiving grid (5) (see FIG. 6).

The invention claimed is:

1. Harness device for a weaving machine comprising an apertured board provided with threading openings for pulling through a series of harness cords wherein this apertured board is composed of at least two separate detachable small partial apertured boards, wherein connecting elements are provided for connecting one or several harness cords to one or several tackle cords or hooks and in that each partial apertured board comprises threading openings and provisions to carry a number of connecting elements.

2. Harness device according to claim 1, wherein the threading openings or the connecting elements are provided with a spring-mounted retaining element.

3. Harness device according to claim 1, wherein in each partial apertured board recesses have been provided in addition to threading openings in order to carry a number of connecting elements.

4. Harness device according to claim 1, wherein a number of connecting elements are provided with an opening through which one or several spindles may be passed, these spindles having the possibility to rest on the small partial apertured boards in order to carry the connecting elements.

5. Harness device for a weaving machine comprising an apertured board provided with threading openings for pulling through a series of harness cords wherein this apertured board is composed of at least two separate detachable small partial apertured boards, wherein connecting elements are provided for connecting one or several harness cords to one or several tackle cords or hooks and in that the partial apertured board comprises positioning means, which have been provided to position a number of connecting elements in a desired connecting position.

6. Harness device according to claim 5, wherein the said positioning means are provided in the said threading openings or in a recess provided next to each threading opening.

7. Harness device according to claim 5, wherein the positioning means comprise one or several grooves and/or guide pins which have been designed to co-operate with an edge of the connecting element in that the connecting element automatically takes up a connecting position when it is put into the threading opening or the recess.

8. Harness device according to claim 5, wherein the said positioning means comprise a spindle, which is passed through the openings of a series of connecting elements.

9. Harness device according to claim 5, wherein it comprises connecting elements in two parts in order to connect one or several harness cords to one or several tackle cords or hooks and in that the positioning means have been provided to carry at least one part of the number of connecting means.

10. Method for building up a harness device, comprising:

providing an apertured board composed of at least two separate detachable small partial apertured boards, providing a series of harness cords, providing the apertured board with threading openings for pulling through the series of harness cords, dividing the harness cords into different groups, and pulling the harness cords through the threaded openings in respective small partial apertured boards.

11. Method for building up a harness device, comprising:

providing an apertured board composed of at least two separate detachable small partial apertured boards, providing a series of harness cords, providing the apertured board with threading openings for pulling through the series of harness cords, dividing the harness cords into different groups, and pulling the harness cords through the threaded openings in respective small partial apertured boards, providing tackle cords or hooks, providing connecting elements for connecting one or several harness cords to one or several tackle cords or hooks, wherein these connecting elements comprise first and second parts to be connected, and connecting the first parts carried by a partial apertured board to the corresponding second parts by the same motion of the partial apertured board.

12. Method for building up a harness device according to claim 11, further comprising keeping a number of second parts to be connected of the connecting elements in a connecting position by means of a comb.

13. Method for building up a harness device according to claim 11, further comprising connecting one or several harness cords to one or several tackle cords or hooks by means of the connecting elements and subsequently raising the small apertured boards, drawing the connecting elements through the threading openings, and subsequently placing the small partial apertured boards into a receiving grid, so that the complete apertured board is constituted.

14. Method for building up a harness device according to claim 11, further comprising connecting one or several harness cords to one or several tackle cords or hooks by means of the connecting elements, subsequently lowering the small apertured boards, and subsequently placing the small partial apertured boards into a receiving grid, so that the complete apertured board is constituted.

* * * * *